US007584914B2

(12) United States Patent
Nishikawa et al.

(10) Patent No.: US 7,584,914 B2
(45) Date of Patent: Sep. 8, 2009

(54) DRAINAGE PIPE WASHING APPARATUS

(75) Inventors: Hiroyuki Nishikawa, Tokyo (JP); Tetsuo Ishikawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 207 days.

(21) Appl. No.: 10/571,253

(22) PCT Filed: Sep. 15, 2004

(86) PCT No.: PCT/JP2004/013857

§ 371 (c)(1),
(2), (4) Date: Mar. 9, 2006

(87) PCT Pub. No.: WO2005/028114

PCT Pub. Date: Mar. 31, 2005

(65) Prior Publication Data

US 2006/0283991 A1 Dec. 21, 2006

(30) Foreign Application Priority Data

Sep. 18, 2003 (JP) ..... 2003-326562
Sep. 18, 2003 (JP) ..... 2003-326564

(51) Int. Cl.
*B02C 23/36* (2006.01)

(52) U.S. Cl. ..... 241/46.013; 134/115 G; 134/168 C

(58) Field of Classification Search ..... 134/115, 134/115 G, 116, 166 R, 168 C; 241/46.013–46.016, 241/101.2; 4/DIG. 4
See application file for complete search history.

(56) References Cited

U.S. PATENT DOCUMENTS 2,391,034 A * 12/1945 O'Brien ..... 4/629

FOREIGN PATENT DOCUMENTS

| | | |
|---|---|---|
| JP | UM-A-61-139743 | 8/1986 |
| JP | UM-A-03-019542 | 2/1991 |
| JP | A-09-122527 | 5/1997 |
| JP | A-10-043620 | 2/1998 |
| JP | A-2001-200564 | 7/2001 |
| JP | A-2002-059022 | 2/2002 |
| JP | A-2002-088858 | 3/2002 |
| JP | A-2002-248368 | 9/2002 |
| JP | A-2002-292300 | 10/2002 |
| JP | A-2002-336722 | 11/2002 |
| JP | A-2003-024813 | 1/2003 |
| JP | A-2003-211015 | 7/2003 |

* cited by examiner

*Primary Examiner*—Mark Rosenbaum
(74) *Attorney, Agent, or Firm*—Morgan, Lewis & Bockius LLP

(57) ABSTRACT

A turntable, swing hammers and fixed teeth of a garbage disposer are combined with a cylindrical pipe in one body, and arranged to be attachable/detachable with respect to a hopper.

A guide pipe branching upward from an upstream upper end portion of a S-trap formed in a drainage pipe in the garbage disposer is provided, and a water injection nozzle is set on the guide pipe.

11 Claims, 9 Drawing Sheets

DRAINAGE PIPE WASHING APPARATUS

TECHNICAL FIELD

The present invention relates to a garbage disposer adapted to pulverize-dispose garbage generated in a kitchen and the like, and more particularly to a garbage disposer in which maintenance is facilitated.

In addition, the present invention relates to a drainage pipe washing apparatus, and more particularly to a drainage pipe washing apparatus suitable for washing of a drainage pipe in a kitchen, a rest room and the like.

BACKGROUND ART

In a general household and a restaurant, a garbage disposer adapted to pulverize and discharge garbage into a sewage line is widely used. The garbage disposer is fixed to a lower portion of a drain hole of a sink in a kitchen. The garbage thrown into a hopper of the garbage disposer through the drain hole of the sink in the kitchen is pulverized by a pulverization unit, such as a hammer mill and discharged with flowing water (refer to, for example, JP-A-2002-059022 and JP-A-2002-292300).

This kind of garbage disposer has a structure in which an upper hopper, a turntable held in a bottom portion of the hopper, and a turntable driving motor provided in a lowermost portion of the hopper are formed so as to be united together with an upper end portion of the hopper joined to the drain hole of the sink in the kitchen from the lower side thereof. A plurality of swing hammers are swingably fixed by pins to the portion of an upper surface of the turntable which is close to an outer edge thereof, and vertical rib-like fixed teeth are formed on an inner circumferential surface of a lower end portion of the hopper. When the turntable is driven, the swing hammers compress the garbage on the turntable against the fixed teeth and thereby pulverize the garbage. The pulverized garbage falls from clearances among the fixed teeth to the lower side of the turntable, and discharged into the drainage pipe.

When the garbage disposer is used, it is necessary that the pulverized garbage be washed off with the water made to flow onto the turntable for a certain period of time even after the turn table is stopped. However, it is difficult to completely clean the interior of the garbage disposer with only the flow of tap water from a water supply.

Especially, after garbage of a high viscosity is disposed, the leftovers of the pulverized garbage are deposited on the inner wall surface of the hopper and on the turntable, and these leftovers are decayed and cause an offensive odor to occur.

Therefore, it is necessary to wash off the leftovers on the inner surface portion of the garbage disposer by using a brush, sponge, water, or a cleaning liquid. However, in a related art garbage disposer, a space on the side of a rear surface of the turntable is a closed space into which the hand of a user cannot be inserted, so that the rear surface of the turntable and a drainage passage below the same cannot be washed.

In a kitchen provided with a garbage disposer in which garbage is pulverize-disposed, oil and viscous garbage in the pulverized garbage are turned into sludge, which is deposited on the inner portion of the drainage pipe to cause an offensive odor to occur and the drainage pipe to be blocked up in some cases. The apparatuses, which have heretofore been proposed, to wash off such dirt from the drainage pipe include the following.

For example, the system for disposing garbage occurring in a kitchen disclosed in JP-A-2001-200564 is formed by connecting a branch pipe to an upstream side of an S-trap in a drainage pipe so that the interior of a drainage pipe can be washed by inserting a hose into the branch pipe and subjecting the interior of the drainage pipe to high-pressure cleaning, or by supplying a washing liquid from the branch pipe and subjecting the interior of the drainage pipe to cleaning using a chemical liquid.

In the water-closet disclosed in JP-A-2002-088858 is formed by connecting a storage tank and a pump to a drainage pipe via a branch pipe so that the water in the storage tank to the drainage pipe is made to flow into the drainage pipe by the pump and subject the interior of the drainage pipe to cleaning using a chemical liquid.

In the structure formed by connecting a branch pipe to a drainage pipe, inserting a hose into the branch pipe, and high-pressure cleaning the interior of the drainage pipe, or by supplying a cleaning liquid into the drainage pipe to clean the interior the same with a chemical liquid, it takes time every time the hose is inserted into the branch pipe on the lower side of the sink in the kitchen, and it is inconvenient to carry out a cleaning operation as daily work. The cleaning operation using a cleaning liquid naturally needs the expense for the cleaning liquid.

The water-closet apparatus in which the storage tank and pump are connected to the drainage pipe via the branch pipe with the water in the storage tank made to flow in the drainage pipe to thereby clean the interior thereof takes much equipment cost with the storage tank and pump occupying a large space.

DISCLOSURE OF THE INVENTION

Therefore, the present invention has as a first object thereof to provide a garbage disposer the whole of the inner portion of which can be washed.

The present invention has as a second object thereof to provide a drainage pipe washing apparatus not needing a large space, and low in both the equipment cost and operating cost.

To achieve the first object, the garbage disposer according to the present invention is a garbage disposer provided with a turntable at a bottom portion of a hopper, swing hammers fixed to an upper portion of the turntable, and fixed teeth provided on the circumference of the turntable, the turntable being driven by a motor, the garbage in the hopper being thereby pulverized by the swing hammers and fixed teeth, wherein a turntable base, turntable, swing hammers and fixed teeth are integrated in a cylindrical member and form a pulverization mechanism into a unitary unit structure so that the pulverization unit can be inserted from the above into the vertical cylindrical hopper and withdrawn therefrom freely.

The pulverization mechanism including the turntable, swing hammers, and fixed teeth of the pulverization unit may be formed to be replacable.

The pulverization unit may be provided with an attachable/detachable upper cover, which may have a water filling port in an upper wall thereof. The pulverization unit may also be provided with a dome type space part continuing from a lower surface thereof to the water filling port.

Between the water filling port of the upper cover and dome type space, a baffle plate for preventing the scattering of pulverized objects may be provided.

The hopper and upper cover may be provided with a cover fixing mechanism including recesses and projections.

The portion of the upper cover at which the upper cover is engaged with the hopper may be provided with a safety switch of the driving motor. The safety switch may be formed so that the safety switch is turned on when the upper cover is engaged with the hopper and turned off when the upper cover is removed to thereby prevent the starting of the motor.

To achieve the second object, the drainage pipe washing apparatus according to the present invention is provided with a guide pipe branching from the drainage pipe toward the upstream side, and a water injection nozzle provided so as to be opposed to an opening of the guide pipe, the water injection nozzle and a water pipe being connected together by a water distributing pipe with a water stop pipe provided on the water distributing pipe, the water being injected from the water injection nozzle into the drainage pipe to wash the interior of thereof.

In order that the water injected from the water injection nozzle flows along the inner surface of the drainage pipe, the position and angle of the water injection nozzle may be set.

The guide pipe may be fixed vertically to an upper end of the upstream side portion of a drainage trap in the drainage pipe. When high-pressure water is injected from the upstream side of the drainage trap toward a lower portion thereof, sludge-like dirt, sand and shells staying in a bottom portion of the trap can be discharged even when the trap is of any of S-trap and P-trap.

The drainage pipe washing apparatus according to the present invention may be formed by connecting the guide pipe to a lower portion of a side surface of the hopper, and providing the water injection nozzle so as to be opposed to the opening of the guide pipe, the water injection nozzle and water pipe being connected together by the water distributing pipe, in which the water stop valve is provided, the water being injected from the water injection nozzle into the hopper so as to wash the interior of the hopper and drainage pipe.

Instead of the water stop valve, an electromagnetic valve may be used, and a control unit for opening and closing the electromagnetic valve may be provided.

A control unit for opening the electromagnetic valve for a predetermined period of time after the garbage disposer is stopped may also be provided.

BRIEF DESCRIPTION OF THE DRAWINGS

FIG. 4(*b*) is a front view of the pulverization unit;

FIG. 6(*b*) is a longitudinal sectional view of the upper cover;

Figure 1:
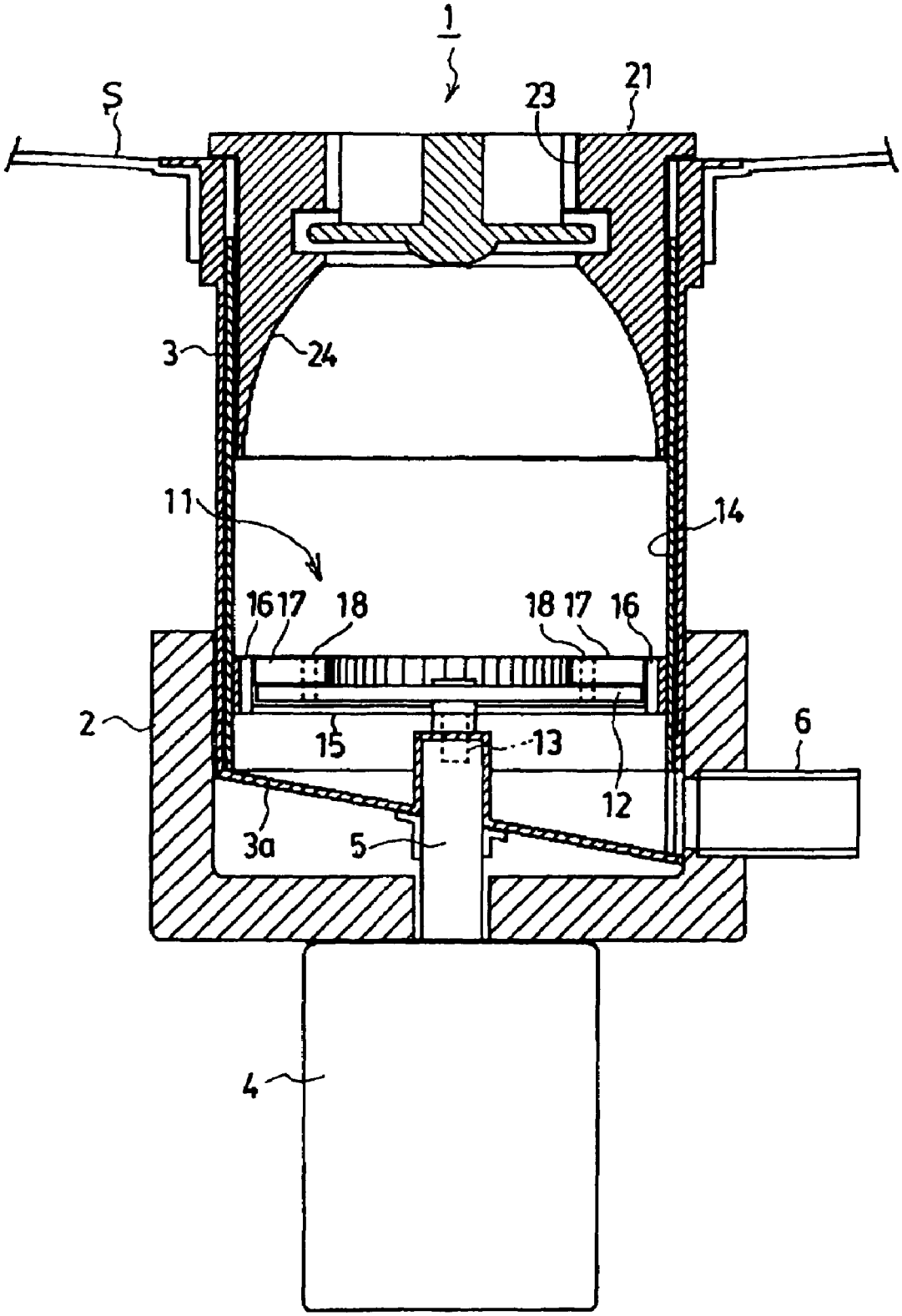
FIG. 1 is longitudinal sectional view of an embodiment of the garbage disposer according to the present invention.

A reference numeral 1 in the drawings denotes a garbage disposer, 2 a frame, 3 a hopper, 3*a* a bottom plate, 3*b* an L-shaped guide groove, 4 a motor, 5 a shaft, 6 a drainage pipe connecting port, 7 a push switch, 11 a pulverization unit, 12 a turntable, 13 a shaft, 14 a cylindrical pipe, 15 a turntable base, 16 fixed teeth, 17 swing hammers, 18 pins, 21 an upper cover, 22 a projection, 23 a water injection port, 24 a dome type space, 25 a small-height circular flat space, and 26 a disc type baffle plate.

Also, 101 a sink, 102 a water pipe, 105 a garbage disposer, 106 drainage pipe, 107 an S-trap, 108 a guide pipe, 108 a water injection nozzle, 110 a nozzle water distributing pipe, 111 a water stop valve, 112 an inclined bottom plate, 113 a pulverization mechanism, 114 an electromagnetic valve, 115 a garbage disposer control unit, and 116 a garbage disposer driving motor.

BEST MODE FOR CARRYING OUT THE INVENTION

First Embodiment

FIG. 1 shows a garbage disposer 1 fixed to a sink S in a kitchen. A reference numeral 2 denotes a part of a frame 2, on which a hopper 3 is mounted, and an upper end of the hopper 3 is fitted in a hole of a sink S in the kitchen. An attachable/detachable pulverization unit 11 is provided fixedly in the hopper 3, an upper cover 21 is fixed to the pulverization unit 11. A shaft 13 of a turntable 12 fixed to the pulverization unit 11 is fitted in a shaft 5 of a motor 4, and the motor 4 fixed to the frame 2 drives the turntable 12 of the pulverization unit 11. A bottom plate 3*a* of the hopper 3 is inclined downward toward a drainage pipe connecting port 6, and the garbage pulverized by the pulverization unit 11 and water flow on the inclined bottom plate 3*a* toward the drainage pipe connecting port 6.

Figure 2:
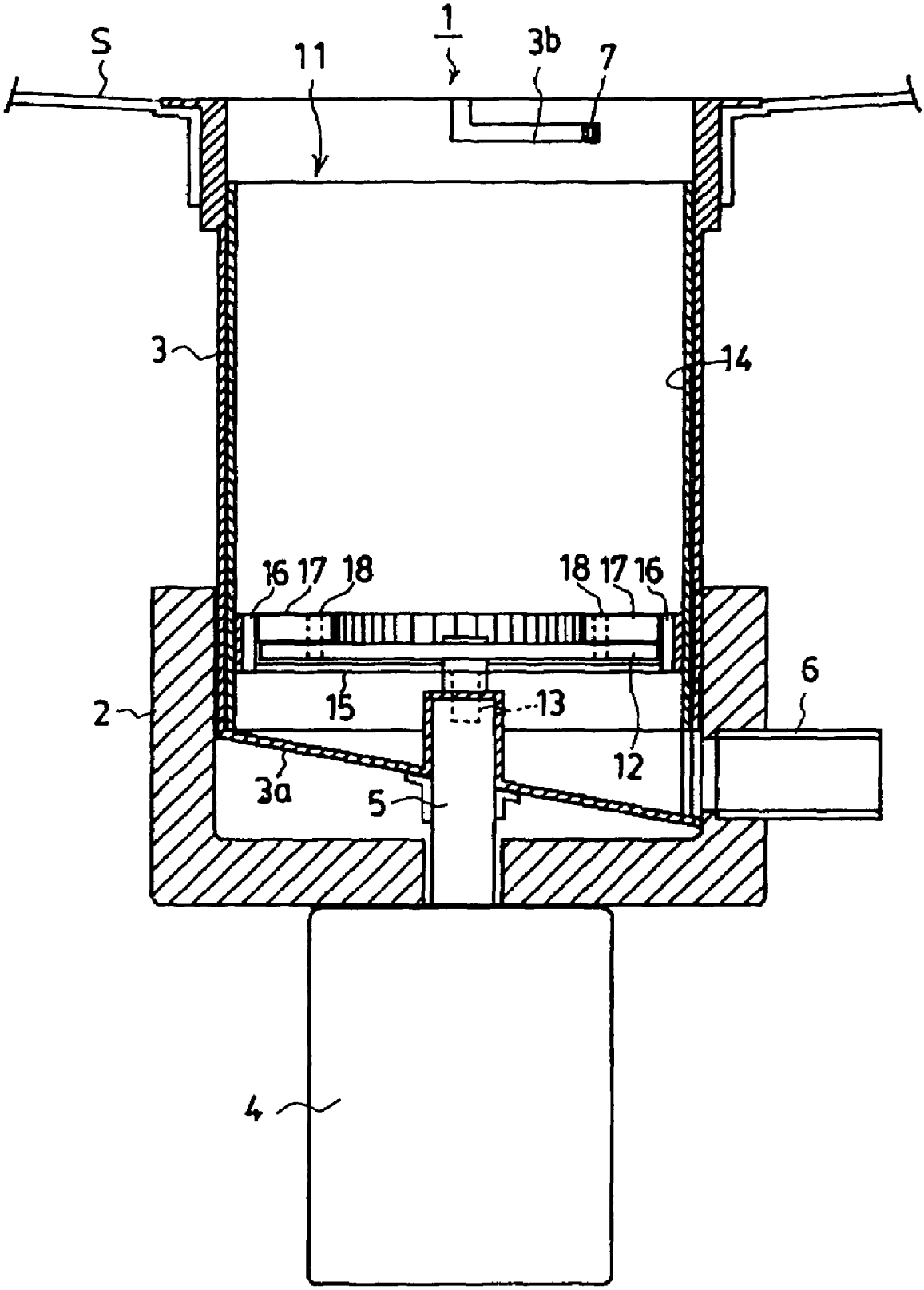
FIG. 2 is a longitudinal sectional view of the garbage disposer with an upper cover removed.
Figure 3:
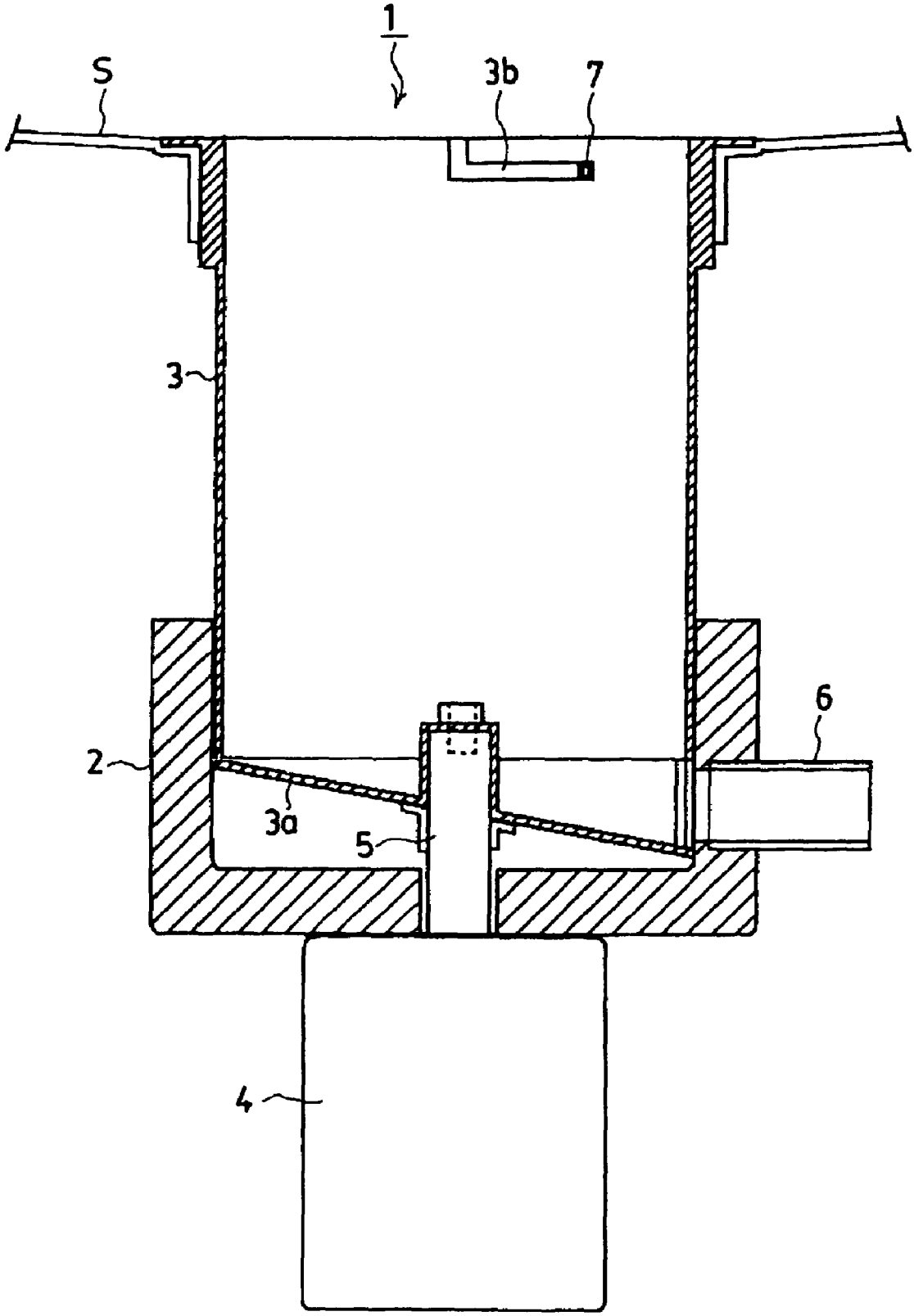
FIG. 3 is a longitudinal sectional view of the garbage disposer with the upper cover and a pulverization unit removed.

FIG. 2 shows the garbage disposer 1 with the upper cover 21 removed, and FIG. 3 the garbage disposer 1 with the pulverization unit 11 also removed. An inner surface of the hopper 3 is provided with an L-shaped groove 3*b* extending downward from an upper end portion thereof and bent at right angles horizontally. A projection 22 shown in FIG. 5 of the upper cover 21 is fitted from the above into the L-shaped guide groove 3*b*, raised and turned clockwise, so that the upper cover 21 is locked. In a terminal end portion shown in FIG. 2 of the L-shaped guide groove 3*b*, a waterproof push switch 7 is provided. When the upper cover 21 is locked, the projection 22 thereof presses the push switch 7 to cause the push switch 7 to be turned on. The push switch 7 forms an AND circuit with a starting switch (not shown) fixed to a circumference of a sink S in a kitchen. Thus, the safety of the garbage disposer is devised so that the motor 4 is not started even when the starting switch is turned on unless the upper cover 21 is completely engaged with the hopper 3.

Figure 4A:
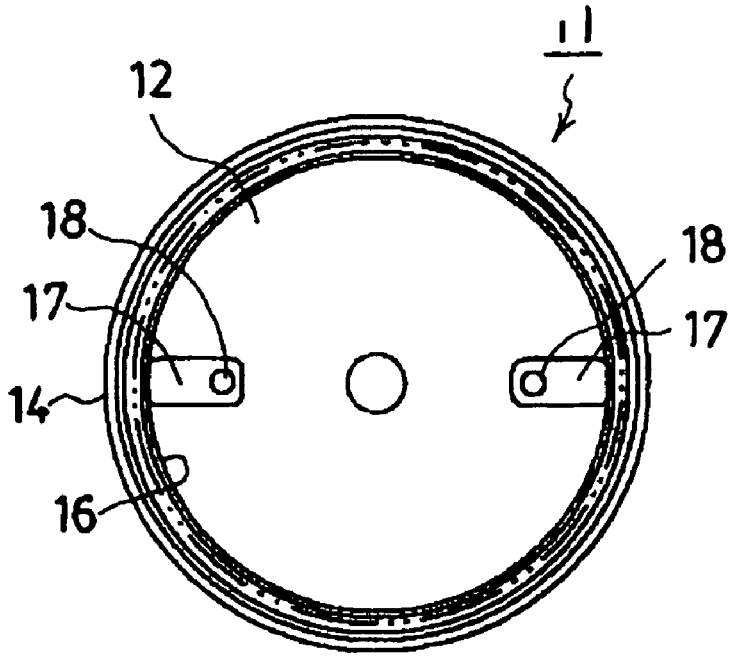
FIG. 4(*a*) is a plan view of the pulverization unit.
Figure 4B:
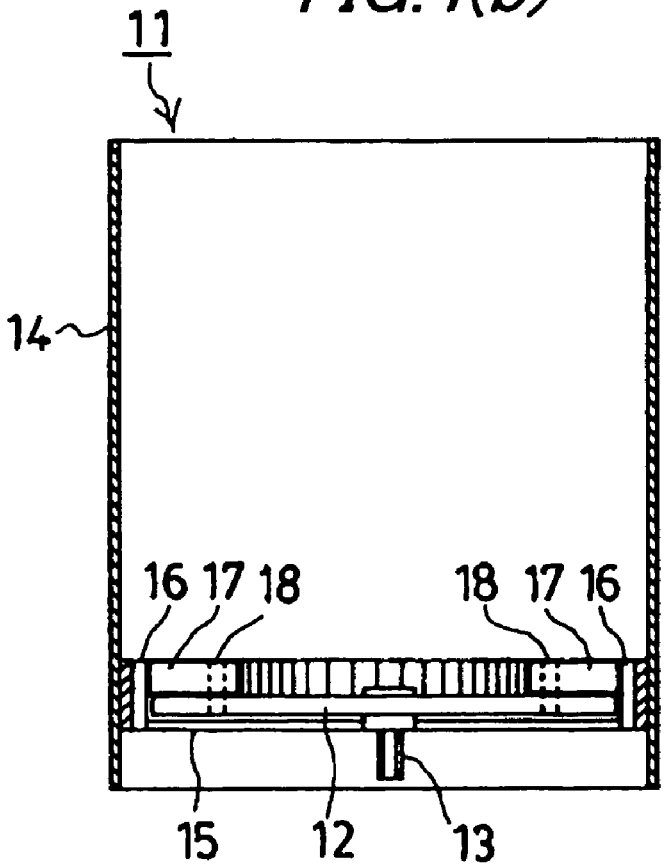

FIG. 4(*a*) and FIG. 4(*b*) show the pulverization unit 11. In an inner portion of an upper and lower side-opened cylindrical pipe 14, the turntable base 15, turntable 12 and fixed teeth 16 are fixed. An outer diameter of the cylindrical pipe 14 is substantially equal to an inner diameter of the hopper 3, and the cylindrical pipe 14 is fitted in the hopper 3 without a distance. The turntable base 15 is provided at a central portion thereof with a bearing (not shown), and the shaft 13 of the turntable 12 projects downward through the bearing. The fixed teeth 16 are internal gear type parts having vertical grooves provided at predetermined intervals over the whole circumference of an inner circumferential surface of a ring type member. Two swing hammers 17 are fixed to an upper surface of the turntable 12 by pins 18. When the turntable 12 is rotated, the swing hammers 17 are turned in the radial direction owing to the centrifugal force, and the garbage on the turntable 12 is compressed on the fixed teeth 16 and pulverized. The shaft 13 of the turntable 12 of the pulverization unit 11 and the shaft 5 of the motor 4 form a pair of elements like a hexagonal shaft and a hexagonal hole and the like one of which is capable of being fitted into and withdrawn from the other, and the pulverization unit 11 can be removed from the hopper 3 by withdrawing the former perpendicularly upward from the latter.

Since the pulverization unit 11 is thus formed attachably/detachably, the bottom plate 3*a* of the hopper 3 and the bottom surface of the pulverization unit 11 can be washed in a safe condition after the pulverization unit 11 is removed from the hopper 3. When a stepped portion, a flange or a handle the illustrations of which are omitted, which serves as a hold is provided in the inner side of the cylindrical pipe 14, the attachability/detachability of the pulverization unit is improved.

The turntable base 15 may have either a disc type shape or the shape of spokes of a wheel. When the turntable is formed in the shape of a disc, it is desirable to design the part so as to have substantially no clearance for the purpose of preventing dust from entering the clearance. The turntable base 15, the turntable 12 and the fixed teeth 16 can be removed from the cylindrical pipe 14, and the swing hammers 17 are also formed attachably/detachably with respect to the turntable 12, i.e., these parts are made separately replaceable.

Figure 5:
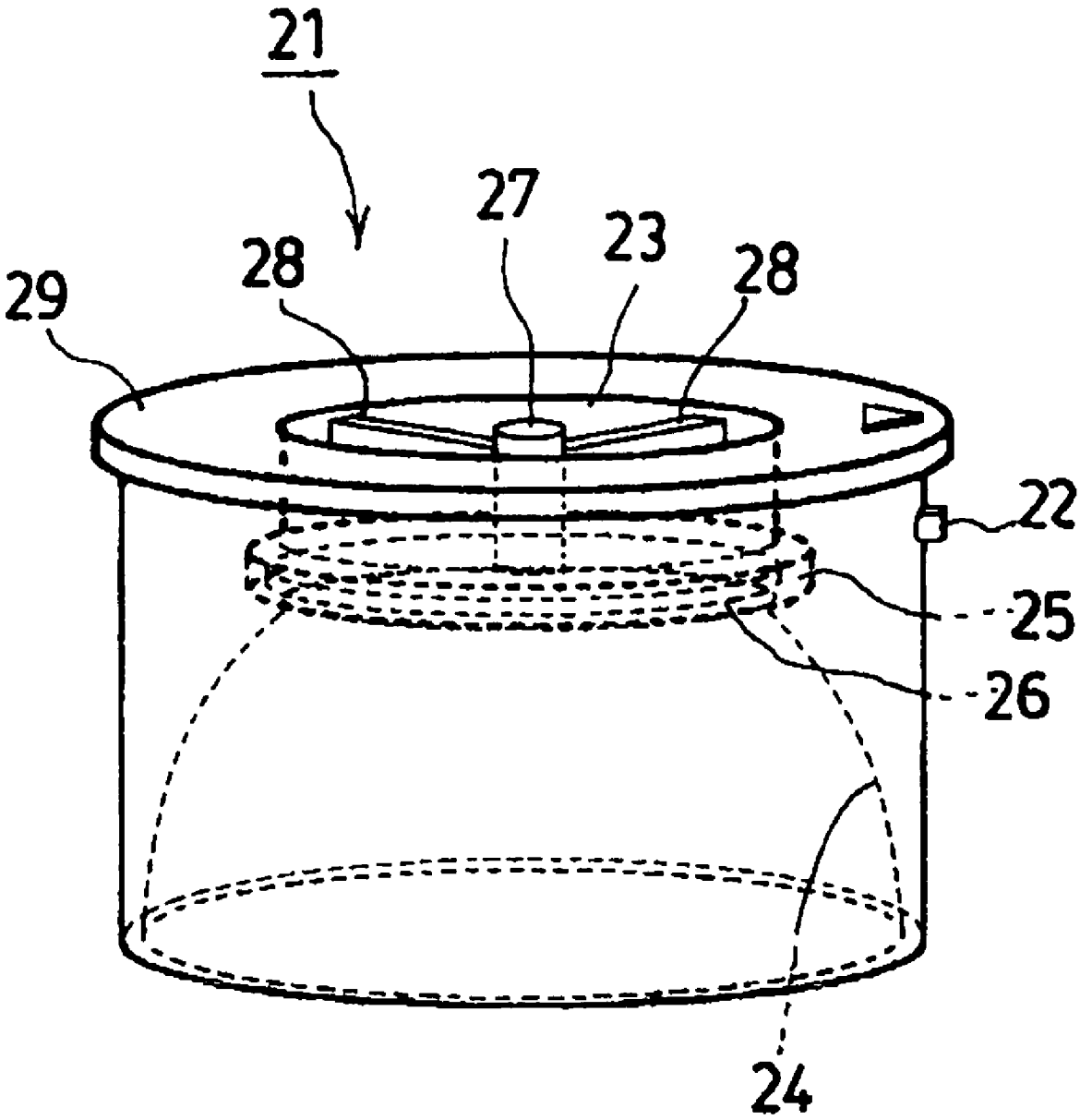
FIG. 5 is a perspective view of the upper cover.
Figure 6A:
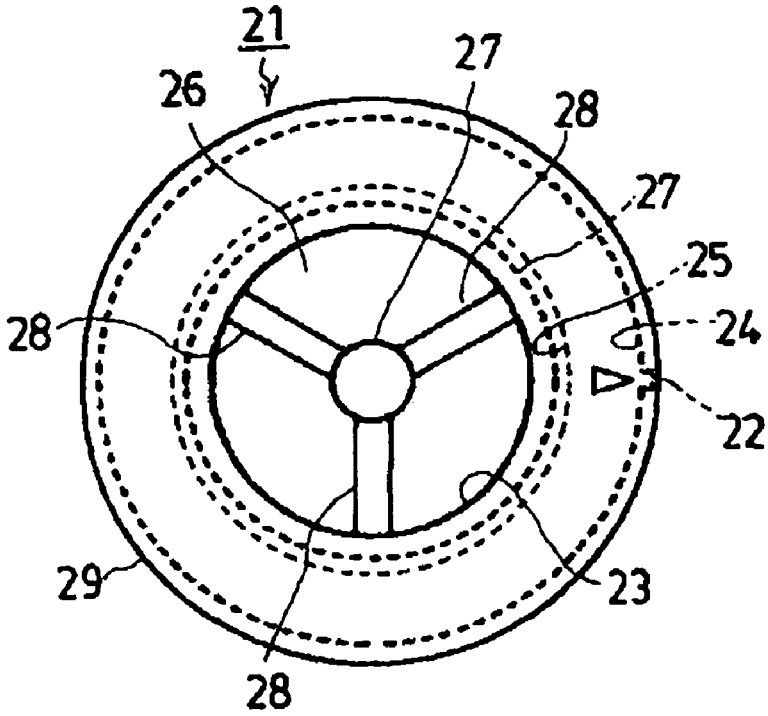
FIG. 6(*a*) is a plan view of the upper cover.
Figure 6B:
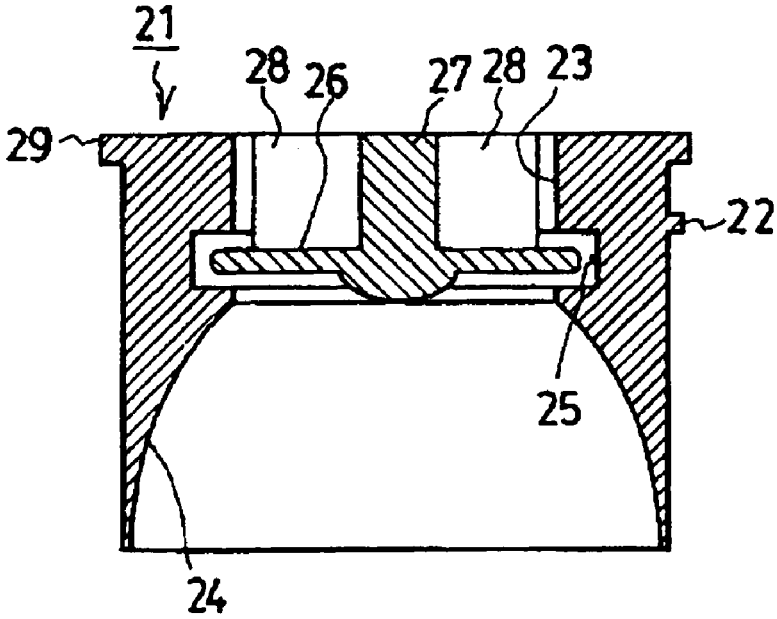

FIG. 5, FIG. 6(*a*) and FIG. 6(*b*) show the upper cover 21. The outer appearance is of a substantially cross-sectionally circular cylinder, and a straight pipe type water injection port 23 extends from a central portion of the upper surface to a vertically intermediate portion. Between an upper portion of the dome type space part 24 and a lower portion of the water injection port 23, a larger-diameter small-height circular flat space part 25 is formed. In the interior of the circular flat space part 25, a disc type baffle plate 26 is provided. The disc type baffle plate 26 is joined to the inner wall surface of the water injection port 23 via the shaft 27 on the upper surface and spoke portions 28 extending from the shaft 27 in the three directions. As mentioned above, the projection 22 is provided on the portion of the upper cover 21 which is somewhat lower than a flange portion 29 at an upper end of the upper cover 21. When the projection 22 is fitted from the above in the L-shaped groove 3*b* of the hopper 3 with the upper cover 21 turned clockwise, the upper cover 21 is fixed to the hopper 3 as shown in FIG. 1. However, the upper cover 21 cannot be fixed to the hopper 3 with the shaft 13 of the turntable 12 in the pulverization unit not fitted in the shaft 5 of the motor 4 in which state the pulverization unit 11 is floated.

In order to dispose garbage, the upper cover 21 is removed from the hopper 3 as shown in FIG. 2, and garbage is thrown into the pulverization unit 11. After the upper cover 21 is then fixed to the hopper 3 as shown in FIG. 1, the water is made to flow into the interior of the pulverization unit 11 to turn the starting switch on. The water is diffused into the dome-shaped space part 24 through the water injection port 23 of the upper cover 21 and circular flat space part 25. When the turntable 12 is rotated at a high speed, the garbage and water are spattered from the center of the turntable 12 in the radial direction. Apart of the garbage is held between the fixed teeth 16 and swing hammers 17 of the pulverization unit 11 and pulverized, and the pulverized garbage falls with the water onto the upper surface of the bottom plate 3*a* of the hopper 3, and discharged into the drainage pipe. The remaining garbage and water impinge upon the inner wall surface of the dome-shaped space part 24 and baffle plate 26 above the dome-shaped space part 24, and are reflected downward and spattered in the radial direction. Such actions are repeated, and, finally, the whole of the garbage is pulverized and discharged.

Between the water injection port 23 of the upper cover 21 and dome-shaped space part 24, the disc type baffle plate 26 is provided, and formed so as to cover the upper end portion of the dome type space. Therefore, the garbage and water do not fly out to a position above the upper cover 21 during the pulverization-disposal of the garbage, and the water is supplied continuously into the interior of the dome type space part 24 through a clearance between the cylindrical flat space part 25 and disc type baffle plate 26.

The garbage disposer according to the present invention does not need a tool for fixing and removing the pulverization unit, and the fixing and removing of the pulverization unit are very easily done. Therefore, the work efficiency during the washing of the lower surface of the pulverization unit and bottom portion of the hopper is very high. Moreover, the efficiency in replacing damaged structural parts including damaged fixed teeth, turntable and swing hammers is far higher than that in a related art garbage disposer.

Second Embodiment

Figure 7:
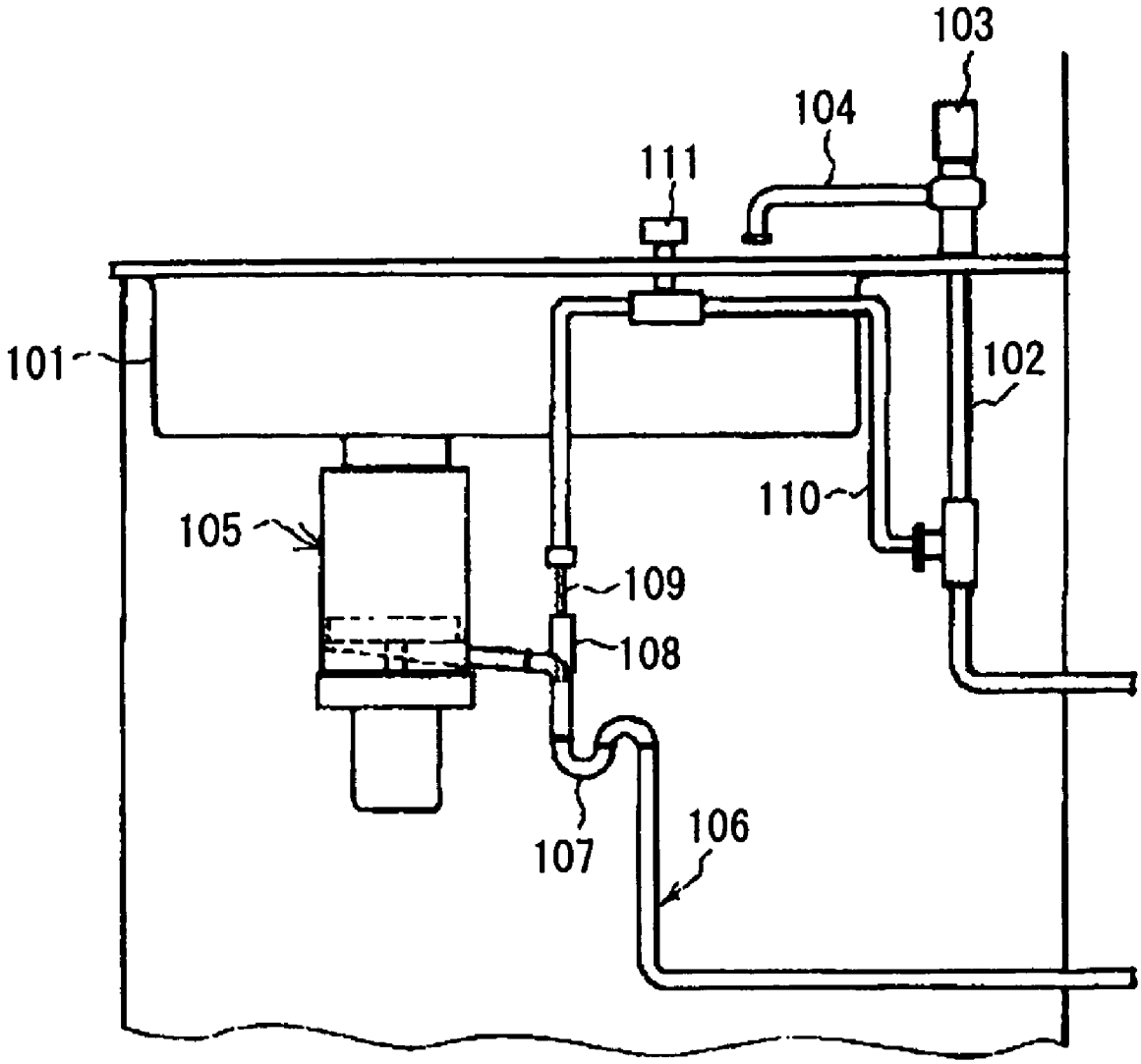
FIG. 7 shows an embodiment of the drainage pipe washing apparatus according to the present invention, and is a construction diagram of a system in which the drainage pipe washing apparatus is applied to a drainage pipe of the garbage disposer.

FIG. 7 shows a sink unit in a kitchen. A reference numeral 101 denotes a sink, 102 a water pipe, 103 a water stop valve, and 104 a faucet. A garbage disposer 105 for pulverize-disposing garbage is joined to a drainage port of a bottom wall of the sink 101, and an S-trap for preventing a reverse flow of an offensive odor is provided at an intermediate portion of a drainage pipe 106 joined to a lower drainage port of the garbage disposer 105. The drainage pipe 106 extends laterally from a drainage port of the garbage disposer 105, bent vertically downward, and joined to the S-trap 107. After the drainage pipe 106 extends from the S-trap 107 in the vertically downward, the same pipe 106 is bent laterally and joined to a swage or an aeration processing tank.

A guide pipe 108 vertically standing up is joined to an upper end of an upstream side vertical portion of the S-trap 107, and a water injection nozzle 109 is provided on the guide pipe 108. A lower portion of the guide pipe 108 is fitted into the drainage pipe 106, and prevents the discharged matter and flowing water from the garbage disposer 105 from flowing through the guide pipe 108 and blowing out upward.

The water injection nozzle 109 is joined to a nozzle water distribution pipe 110 branching from the water pipe 102, and the water stop valve 111 is provided at an intermediate portion of the nozzle water distribution pipe 110. When the water stop valve 111 is opened, a water flow the pressure of which is higher than that of regular water is injected from the water injection nozzle 109 owing to the effect of a narrow injection port of the water injection nozzle 109. The resultant water flows into the drainage pipe 106 through the guide pipe 108, and washes the interior of conduits on the downstream side of the drainage pipe 106. Since the pressure and velocity of flow of this water flow are higher and far higher respectively than those of the water flow discharged from the garbage disposer 105, the sand particles and broken pieces of shells and the like deposited on a lower bottom portion of the S-trap 107 are also blown out to the downstream side, so that the interior of the pipe is washed clean.

The type of the water injection nozzle 109 is not specially limited. The water injection nozzle 109 may be any of the types including a direct jet nozzle, a needle jet nozzle, a cone pattern nozzle, or a rotary jet nozzle in which a nozzle body and a nozzle head are joined together by a swivel joint with an injection port at a front end surface of the nozzle head provided in the portion of the nozzle which is offset from the center thereof, a jet water flow being injected as it draws a circle owing to the rotation of the nozzle head during the injection of the water, and the like. In a certain district, it is determined by regulations that an outlet of the water supply pipe and an inlet of a drainage pipe are arranged so as to be spaced apart from each other by a distance of not shorter than a predetermined distance (not smaller than, for example, 50 mm) so as to prevent the water supply from being contaminated with the drainage water. According to the present invention, it is preferable to use a nozzle of an injection pattern of a narrow directivity angle as the water injection nozzle 109 so as to provide the water injection nozzle 109, which corresponds to the outlet of the water supply pipe, away from the inlet port of the guide pipe 108 by a distance of not shorter than the above-mentioned predetermined level. In any case, it is important that the position and angle of the water injection nozzle 109 be set so as to inject the water from the water injection nozzle 109 reaching the drainage pipe 106 onto the inner wall surface of the drainage pipe 106.

Third Embodiment

Figure 8:
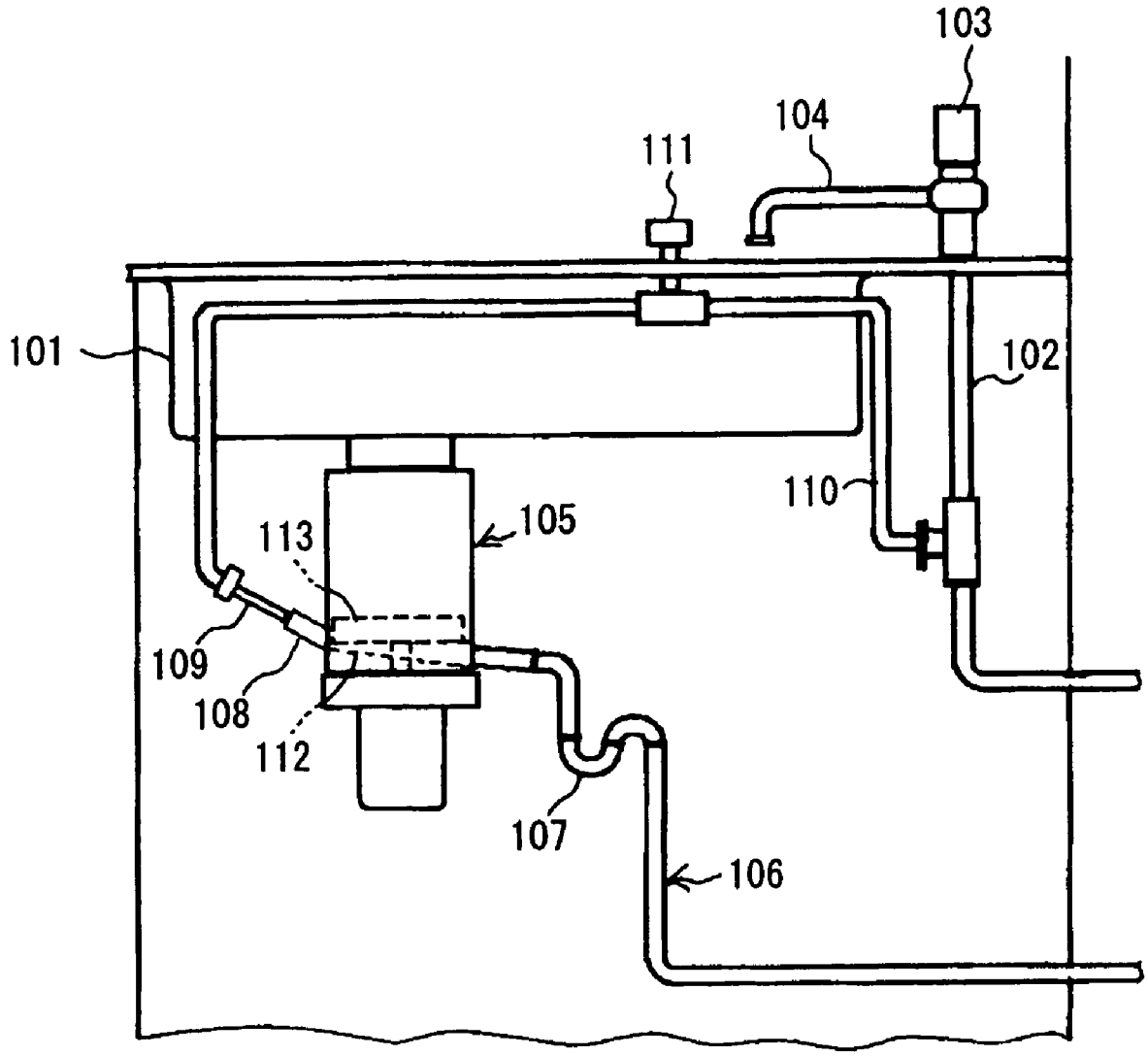
FIG. 8 shows another mode of embodiment, and is a construction diagram of a system in which the drainage pipe washing apparatus is applied to the garbage disposer.

FIG. 8 shows an embodiment for washing the bottom portion of the hopper in the garbage disposer 105. The embodiment is formed so that a guide pipe 108 is joined to a rising side surface of an inclined bottom plate 112 of the hopper, the water being injected from a water injection nozzle 109 provided close to the guide pipe 108 into a bottom portion of the hopper.

When a water stop valve 111 of the water injection nozzle 109 is opened after the garbage pulverization-disposal by the garbage disposer 105 finishes, a jet water flow is injected into a space between the pulverization mechanism 113 of the garbage disposer 105 and the inclined bottom plate 112 of the hopper, and a lower surface of the pulverization mechanism 113 forming a closed space difficult to be washed, the inclined bottom plate 112 of the hopper and the circumferential wall surface of the inclined wall are washed, the water used to wash these parts flowing on the inclined bottom plate 112 to be discharged into the drainage pipe 106.

Fourth Embodiment

Figure 9:
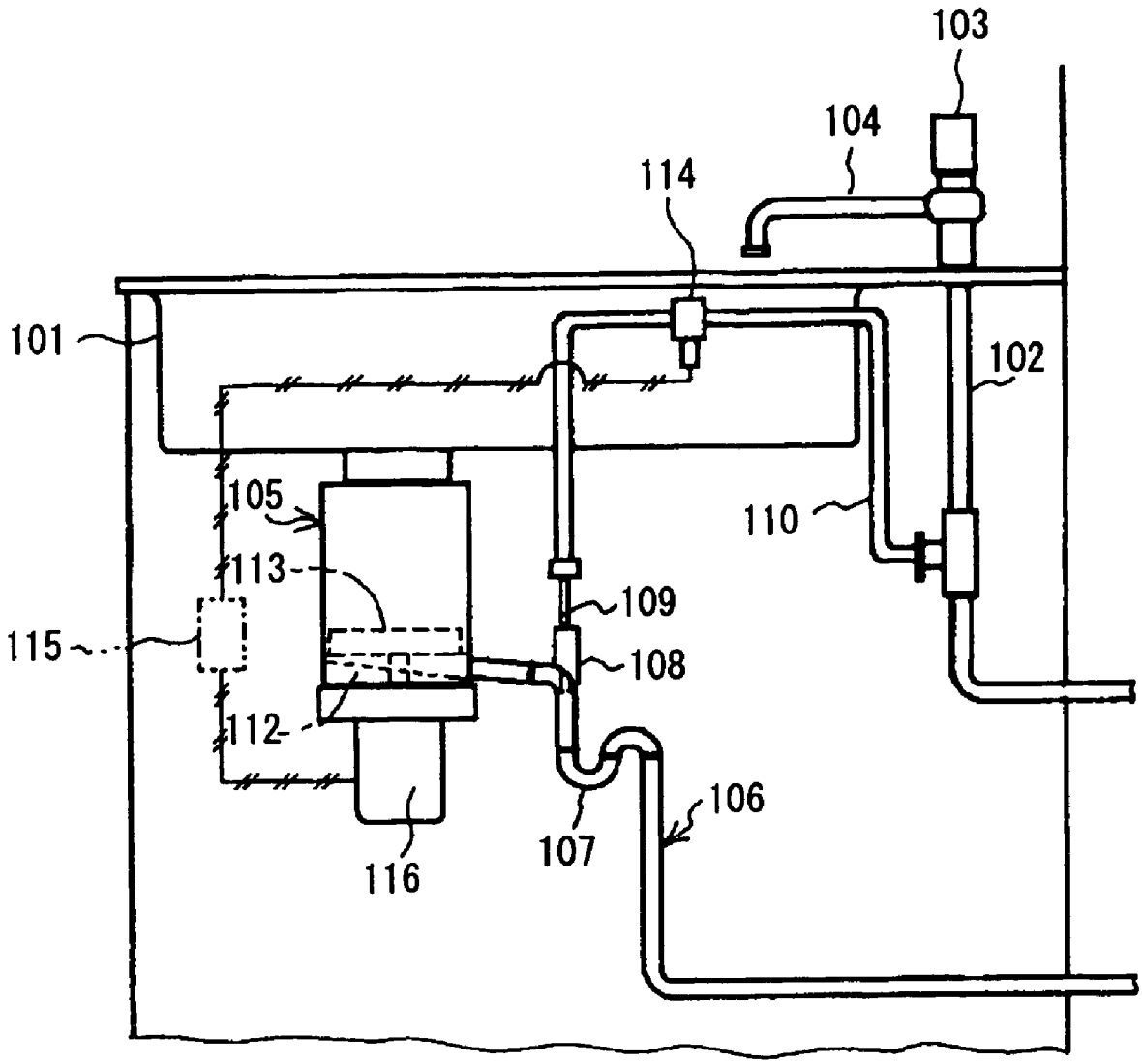
FIG. 9 shows still another mode of embodiment, and is a construction diagram of a system in which the drainage pipe washing apparatus is electrically controlled.

FIG. 9 shows an embodiment in which a washing step is automated. This embodiment is formed by providing an electromagnetic valve 114 in a nozzle water distribution pipe 110 instead of the manual water stop valve with the electromagnetic valve 114 controlled by a garbage disposer control unit 115. When the starting switch for the garbage disposer 105 is turned on, the garbage disposer control unit 115 drives a garbage disposer driving motor 116 for a predetermined period of time and stops the same. In this embodiment, the garbage disposer control unit 115 (control unit 115) is formed so that the control unit 115 opens the electromagnetic valve 114 for a predetermined period of time (for example, 1 minute) after the motor is stopped, and washes the drainage pipe 106. Therefore, the drainage pipe washing process is automatically carried out after the garbage disposal finishes.

The structure shown in FIG. 7 in which the water injection nozzle 109 is provided on the upstream side of the S-trap 107 and the structure shown in FIG. 8 in which the water injection nozzle 109 is provided on the side surface of the bottom portion of the garbage disposer 105 may be combined with each other. Although an illustration is omitted, another water injection nozzle may be provided in the vertical portion and horizontal portion of the part of the drainage pipe 106 which extends forward from the S-trap 107. A plurality of water injection nozzles may also be provided so that the injection nozzles are controlled by a control system including the electromagnetic valve and a control unit of FIG. 9.

Although a structure for washing the drainage pipe in the garbage disposer is described in this embodiment, this embodiment can, of course, be applied as well to a drainage pipe in a kitchen in which a garbage disposer is not provided, and a drainage pipe in a bathroom and a washroom.

This invention is not limited to these modes of embodiment. Various kinds of modifications within the technical scope of the invention are possible, and this invention naturally includes these modifications.

INDUSTRIAL APPLICABILITY

The garbage disposer according to the present invention is formed so that the pulverization unit provided with the turntable and fixed teeth can be attached/detached with respect to the hopper. Therefore, the lower surface of the turntable, the bottom surface of the hopper and the like which the hand of a user usually does not reach can also be washed, so that the kitchen can be sanitarily maintained. Since the pulverization unit can be removed from the hopper, the replacing of the structural parts, such as swing hammers and fixed teeth and the maintenance thereof can be remarkably facilitated.

Since the attachable/detachable upper cover having the water injection port in the upper wall, and dome-shaped space inside thereof is set on the hopper, the garbage flows by convection without being one-sided toward the inner wall surface of the pulverization unit during the pulverization operation, so that the pulverization of the garbage can be carried out effectively.

Since the baffle plate is provided between the water injection port of the upper cover and dome-shaped space, the spattering of the pulverized matter upward from the garbage disposer during the pulverization operation can be prevented.

A structure for fixing the upper cover to the garbage disposer is provided, and the safety switch on the upper cover fixing portion of the garbage disposer. The garbage disposer is formed so that the safety switch is operated when the upper cover is fixed to the garbage disposer and locked up. Therefore, when the upper cover is removed, the motor is not started in error, and this causes the safety of the garbage disposer to be improved.

The drainage pipe washing apparatus according to the present invention is formed so that a tap water is injected from the water injection nozzle provided in the vicinity of the drainage pipe into the drainage pipe directly. Therefore, a water tank and an injection pump are not necessary, and the equipment cost is not need much without a special space for installing the apparatus. In addition, since the drainage pipe washing operation is carried out with highly pressurized water injected thereinto, a washing liquid does not need to be used, and the operation of the apparatus costs low.

In the garbage disposer according to the present invention, the turntable, swing hammers and fixed teeth which constitute the pulverization unit are turned into a unit and formed attachably/detachably with respect to the hopper of the garbage disposer body. This enables the lower surface of the turntable and bottom surface of the hopper and the like which the hand of the user does not usually reach to be washed.

In the drainage pipe washing apparatus according to the present invention, a structure for injecting a tap water from the water injection nozzle provided in the vicinity of the drainage pipe directly into the drainage pipe so as to wash the interior thereof without using a water tank and an injection pump is formed. The saving of the space for installing the drainage pipe washing apparatus and the reduction of the cost are thus attained.

The invention claimed is:

1. A drainage washing apparatus comprising:

a guide pipe;

a water injection nozzle provided so as to oppose to an opening of the guide pipe;

a water distribution pipe joining together the water injection nozzle and a water supply pipe; and a water stop valve provided on the water distribution pipe, wherein a tap water is injected from the water injection nozzle into a drainage pipe so as to wash the interior of the drainage pipe,.

wherein the guide pipe branches from the drainage pipe toward the water injection nozzle, wherein a lower end of the water injection nozzle is spaced apart from the inlet port of the guide pipe.

2. The drainage washing apparatus according to claim 1, wherein a position and an angle of the water injection nozzle are set so that the water injected from the water injection nozzle flows along an inner wall surface of the drainage pipe.

3. The drainage washing apparatus according to claim 1, wherein the guide pipe is fixed substantially vertically to an upper end of an upstream vertical portion of the drainage trap in the drainage pipe.

4. The drainage washing apparatus according to claim 1, wherein the water injection nozzle comprises a narrow injection port.

5. A drainage washing apparatus comprising:

a guide pipe;

a water injection nozzle provided so as to oppose to an opening of the guide pipe;

a water distribution pipe joining together the water injection nozzle and a water supply pipe; and a water stop valve provided on the water distribution pipe, wherein a tap water is injected from the water injection nozzle into a drainage pipe so as to wash the interior of the drainage pipe, wherein the guide pipe is joined to a lower portion of a side surface of a hopper of a garbage disposer.

6. The drainage pipe washing apparatus according to claim 1, wherein the water stop valve comprises an electromagnetic valve, the drainage pipe washing apparatus further comprising a control unit for opening and closing the electromagnetic valve.

7. The drainage pipe washing apparatus according to claim 6, wherein the water injection nozzle is apart from the opening of the guide pipe.

8. The drainage washing apparatus according to claim 6, wherein the control unit opens the electromagnetic valve for a predetermined period of time after a garbage disposer is stopped.

9. The drainage washing apparatus according to claim 5, wherein the water injection nozzle is apart from the opening of the guide pipe.

10. A drainage washing apparatus comprising:

a guide pipe;

a water injection nozzle provided so as to oppose to an opening of the guide pipe;

a water distribution pipe joining together the water injection nozzle and a water supply pipe; and a water stop valve provided on the water distribution pipe, wherein the guide pipe is joined to a lower portion of a side surface of a hopper of a garbage disposer, wherein a tap water is injected from the water injection nozzle into the hopper of the garbage disposer, and wherein the tap water flows to a bottom of the hopper and is discharged to the drainage pipe.

11. The drainage washing apparatus according to claim 10, wherein the tap water is injected into a space between a pulverization mechanism of the garbage disposer and the bottom of the hopper.

* * * * *